US005485915A

United States Patent [19]

Harris

[11] Patent Number: 5,485,915

[45] Date of Patent: Jan. 23, 1996

[54] WRAP-AROUND CARRIER WITH ARTICLE HEEL LOCK

[75] Inventor: Randall L. Harris, Powder Springs, Ga.

[73] Assignee: Riverwood International Corporation, Atlanta, Ga.

[21] Appl. No.: 310,132

[22] Filed: Sep. 21, 1994

[51] Int. Cl.[6] ..... B65D 75/00

[52] U.S. Cl. ..... 206/147; 206/194; 206/197; 206/434

[58] Field of Search ..... 206/140, 147, 206/153, 155, 194, 427, 434, 197

[56] References Cited

U.S. PATENT DOCUMENTS

| | | | |
|---|---|---|---|
| 3,229,892 | 1/1966 | Weiss | 206/434 |
| 3,517,876 | 6/1970 | Stout | 206/434 |
| 4,533,047 | 8/1985 | Calvert | 206/427 |
| 5,310,050 | 5/1994 | Sutherland | 206/194 |
| 5,311,984 | 5/1994 | Harris | 206/140 |

*Primary Examiner*—Paul T. Sewell
*Assistant Examiner*—Marie D. Patterson

[57] ABSTRACT

A wrap-around carrier for packaging curved articles, such as beverage bottles or cans. Retainer flaps extending inwardly from heel cutouts are connected to the side panels and the bottom panel by gusset panels. The fold lines of the gusset panels are arranged to create a bias which maintains pressure on the articles to prevent movement within the carrier. The lower gusset panels are located between the bottom of the adjacent article and the bottom panel of the carrier.

7 Claims, 2 Drawing Sheets

WRAP-AROUND CARRIER WITH ARTICLE HEEL LOCK

FIELD OF THE INVENTION

This invention relates to wrap-around carriers which contain apertures for holding the bottom portions of adjacent articles in place. More particularly, it relates to a wrap-around carrier provided with means in addition to the apertures for securing articles in the carrier.

BACKGROUND OF THE INVENTION

Packaged articles are retained in wrap-around carriers by tightly drawing the wrap about the articles and restraining the upper and lower portions of the articles against movement toward the open ends of the carrier. In the case of bottles, the upper portions are restrained by extending the bottle necks through openings in the top panel of the carrier or by cutouts in the upper part of the side panels through which the outer edge of the bottle crown extends. The lower portions are restrained by heel cutouts through which the bottle heels extend out beyond the side panels. Despite these provisions, if the heel cutout should tear or the wrapper is loose the end bottles could fall out while the package is being carried. It is desirable, therefore, to provide even greater restriction to bottle movement, especially in wrap-around carriers used for packaging relatively large bottles or bottles whose bottom portions are not of a constant diameter.

Approaches to further restrict bottle movement in a wrap-around carrier have generally resulted in the use of extra retainer structure at the ends of the carrier, which is economically undesirable because of the added paperboard this requires. Also, the provision of other structure with article retainer capabilities has typically made it more difficult to continuously run the carrier through a packaging machine at high speeds.

A main object of this invention, therefore, is to provide a wrap-around carrier having improved article retainer means which does not add to the amount of paperboard required in the wrap-around blank and does not prevent a rapid and efficient flow of the articles through the packaging machine.

BRIEF SUMMARY OF THE INVENTION

The wrap-around carrier of the invention is of conventional basic structure, including opposite side panels foldably connected to top and bottom panels and cutouts or apertures located opposite the lower portions of adjacent articles. Unlike conventional carriers, retainer flaps extend inwardly from the apertures, contacting opposite sides of the lower portions of adjacent articles. Each retainer flap is connected to the carrier by an upper gusset panel and a lower gusset panel. At least a substantial portion of each lower gusset panel lies between the bottom panel and the bottom of an associated article.

Preferably, each upper gusset panel is foldably connected to an associated side panel and each lower gusset panel is foldably connected to the bottom panel, with sloped heel panels extending between the side panels and the bottom panel. In a preferred arrangement in which each side panel is in a substantially vertical plane and the bottom panel is in a substantially horizontal plane, each upper gusset panel fold line lies in a plane forming an acute angle with a horizontal plane and each lower gusset panel fold line lies in a plane forming an acute angle with the vertical plane in which the associated side panel lies.

The carrier of the invention reliably prevents outward movement of packaged articles. Further, the carrier structure causes the retainer flaps to automatically lock in place upon forming the side and bottom panels, thereby simplifying the carrier formation process.

The above and other aspects and benefits of the invention will readily be apparent from the more detailed description of the preferred embodiments of the invention which follows.

DETAILED DESCRIPTION OF THE PREFERRED EMBODIMENT

Figure 1:
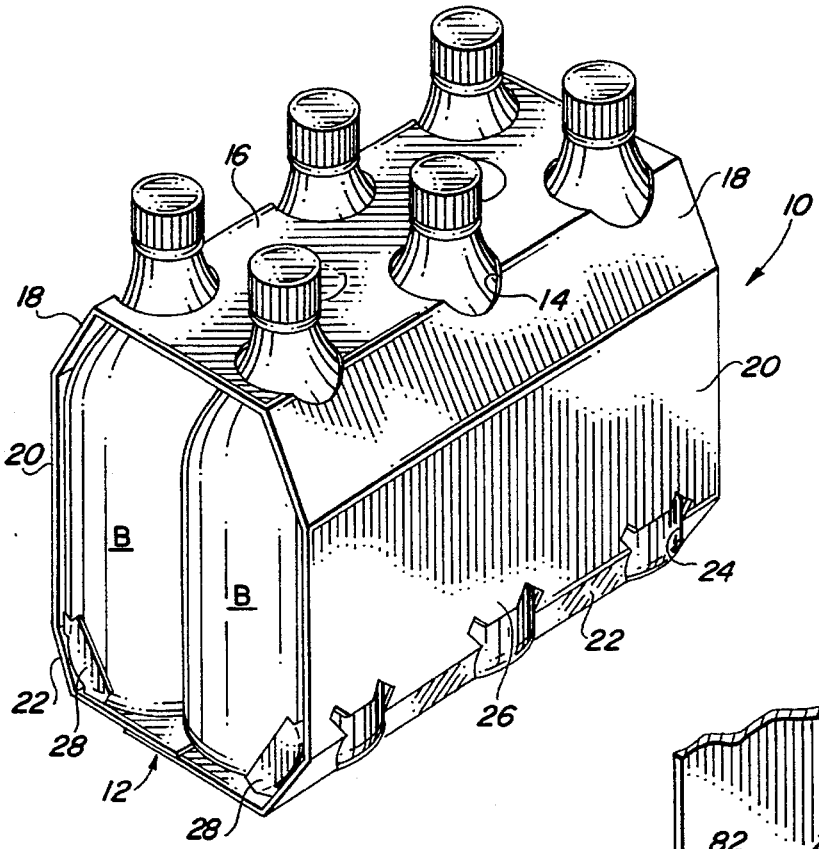
FIG. 1 is a pictorial view of a wrap-around carrier embodying the article retainer features of the invention.

Referring to FIG. 1, the wrap-around carrier 10 is illustrated in connection with six beverage bottles B supported on bottom panel 12. The necks of the bottles extend up through openings 14 in adjacent portions of top panel 16 and the connected sloped shoulder panels 18. The shoulder panels, which are connected to vertical side panels 20, allow the carrier wrapper to more closely follow the contour of the upper portion of the illustrated bottles. They are not directly related to the invention, however, and may or may not be present depending on the shape of the packaged articles. The side panels 20 are connected at their lower end to sloped heel panels 22 in which cutouts 24 are provided for receiving the protruding heel portions of the bottles. Tabs 26 extend down from the side panels 20 and contact the outer heel portions of the bottles.

Figure 2:
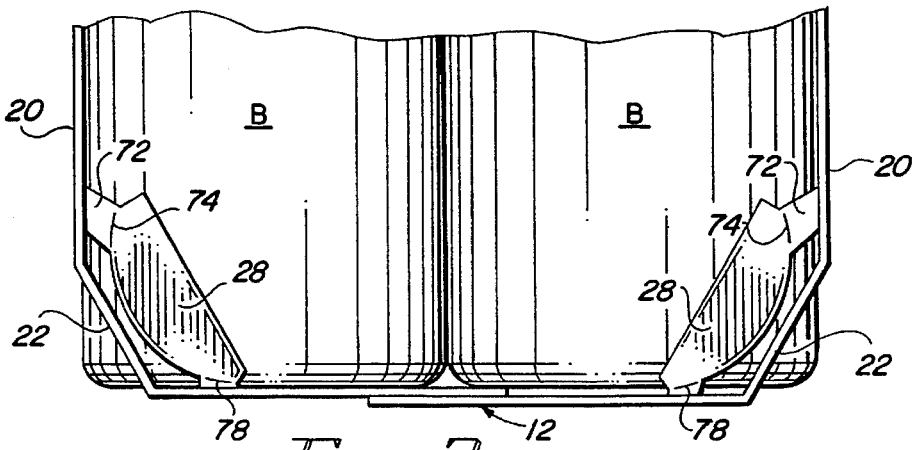
FIG. 2 is an enlarged partial end view of the carrier of FIG. 1.

Retainer flaps 28 are shown in FIGS. 1 and 2 as extending into the interior of the carrier adjacent the outer side edge of the end heel cutouts. Although these are the only retainer flaps visible in these views, it will be understood that similar flaps are present at both side edges of each heel cutout and are in contact with opposite sides of the heel portion of adjacent bottles. Due to the foldable connections between the flaps and the cutout edges, which are described in more detail below, the flaps are biased toward the bottles so as to maintain continuous contact with them. As will be made more clear below, the bottom of the bottles rests on structure connected to the retainer flaps.

Figure 3:
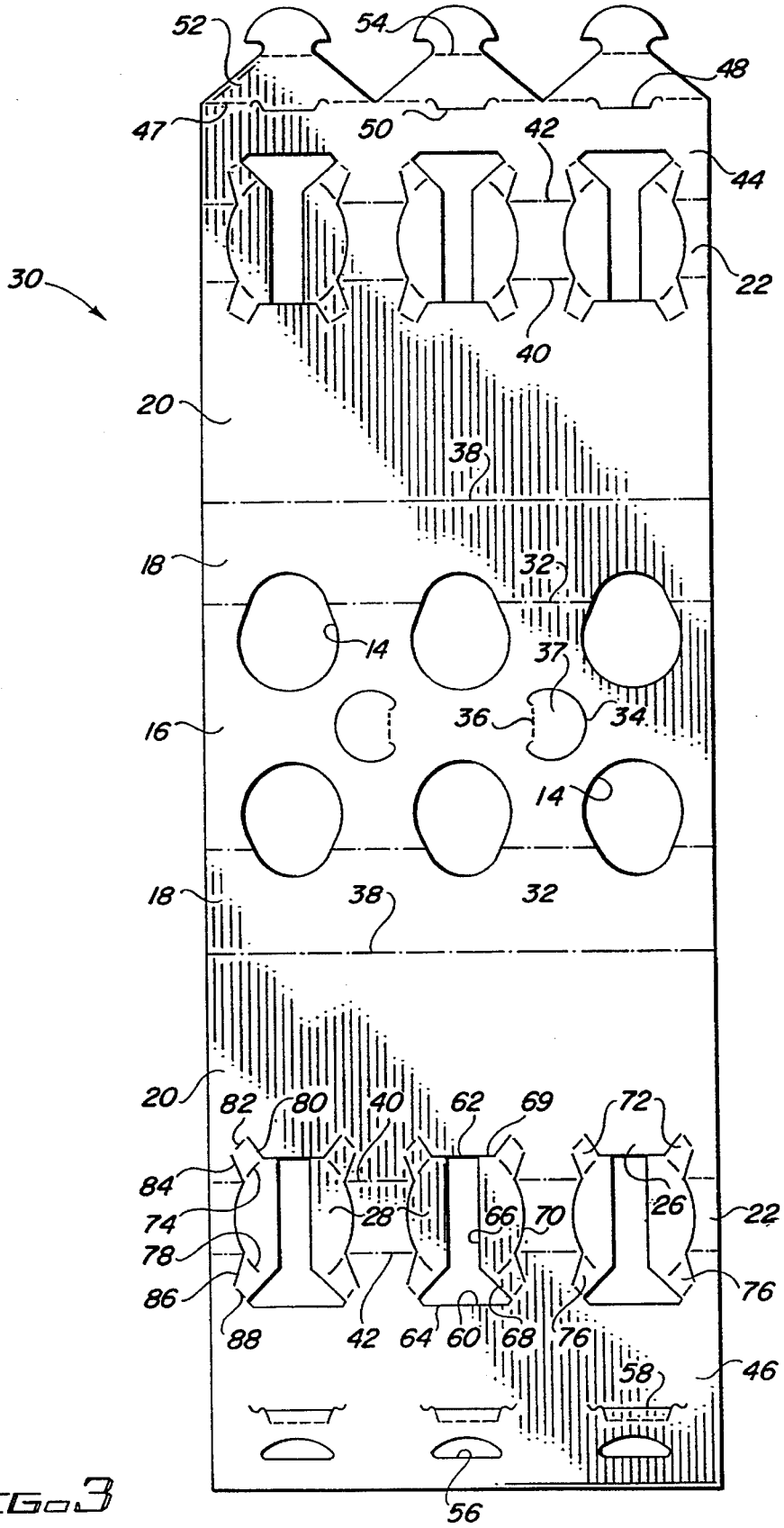
FIG. 3 is a plan view of a blank for forming the carrier of FIG. 1.

Referring now to FIG. 3, wherein like reference numerals to those used in FIGS. 1 and 2 denote like elements, a blank 30 capable of being fabricated into the carrier of FIG. 1 is comprised of a centrally located top panel section 16 connected at opposite sides by fold lines 32 to the short shoulder panel sections 18. Arcuate slits 34 in the top panel, connected at their ends by fold lines 36, provide tabs 37 which when punched down by a user open into finger holes for carrying the package. Fold lines 38 connect the panel sections 18 to the side panel sections 20. If the articles to be packaged do not have necks or are otherwise shaped so as not to extend through the top panel, the openings 14 would of course not be provided.

Fold lines 40, which are interrupted by the heel cutout structure, connect the side panel sections 20 to the heel panel sections 22. Similarly, parallel interrupted fold lines 42 connect the heel panel sections 22 to bottom panel flaps 44 and 46. The bottom panel flap 44 includes fold line 46 which extends the full length of the flap and which is interrupted by slits 48 forming primary male locking tabs 50. Secondary male locking tabs 52, which may include fold lines 54 for ease of insertion, are connected to the bottom panel flap 44 by the fold lines 46. Incorporated in the bottom panel flap 46 are cutouts 56, which include primary female locking edges for engaging the primary male locking tabs 50, and slits 58 adapted to receive the secondary locking tabs 52. These various locking elements are illustrated to demonstrate a typical bottom panel locking arrangement suitable for use with the carrier of the invention, but it should be understood that any desired effective form of bottom panel locking means may be employed.

Still referring to FIG. 3, the portions of the blank which form the heel cutouts and retainer flap structure are comprised in part by cutouts 60, each of which is defined by a relatively short edge 62 in the side panel section 20, a relatively long parallel edge 64 in the associated bottom panel flap, opposite parallel edges 66 extending from the ends of the edge 62 through the heel panel section 22 and into the bottom panel flap, and angled edges 68 connecting the edges 66 and the edge 64. The edges 66, adjacent portions of the edges 68, outwardly extending slits 69 and arcuate slits 70 define the retainer flaps 28. Each retainer flap is connected to an upper gusset panel or tab 72 by fold line 74 and to a lower gusset panel 76 by fold line 78. Each upper gusset panel 72 is formed by slit 80 which extends from the slit 69 to one end of gusset fold line 82, and slit 84 which extends from the arcuate slit 70 to the other end of the gusset fold line 82. Each lower gusset panel 76 is formed by a portion of the cutout edge 68 and slit 86, which extends from the arcuate slit 70 to gusset panel fold line 88. The upper gusset panel fold lines 82 are in the side panel sections 20, while the lower gusset panel fold lines are in the associated bottom panel flap 44 or 46. The upper and lower gusset panel fold lines 82 and 88 of each retainer flap converge toward each other along paths which form an obtuse angle with each other, the purpose of which is explained below.

To form a package from the carrier blank the bottles are arranged in two rows and the top panel section 16 of the blank is placed on top of the bottles, with the necks of the bottles extending through the bottle neck openings 14. The blank is then folded in conventional manner about the fold lines 32 and 38 to form the shoulder and side panels. As the blank is being folded the gusset panels 72 and 76 are punched in to ensure that they fold in the desired direction, and as the gusset panels pivot inwardly about their fold lines they pull the connected retainer flaps with them. The retainer flaps are then physically held open until the folding of the bottom panel flaps about their fold lines 42 begins. As the bottom panel flaps move in toward the bottles the continued folding of the gussets pulls the retainer flaps to their fully open position. Because the gusset panel fold lines 82 and 88 are angled with respect to each other, biases are created at these fold lines by the folding action, resulting in the gusset panels being locked in place when the bottom panel flaps form an angle of substantially 90° with the side panels.

Figure 4:
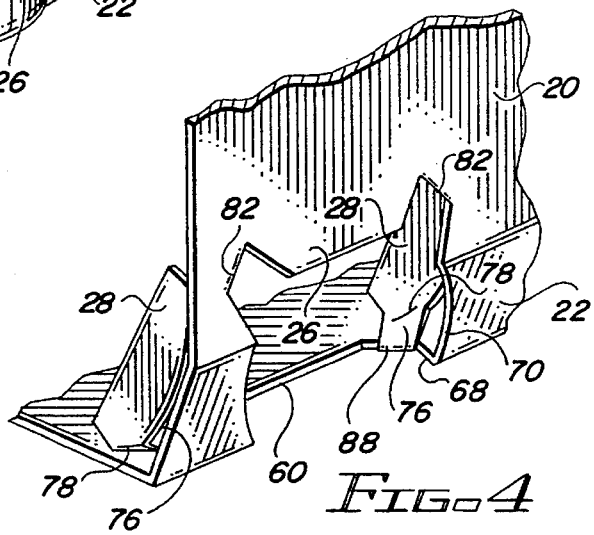
FIG. 4 is an enlarged partial pictorial view of an end of a carrier formed from the blank of FIG. 3.

During the folding of the gusset panels and the hinged movement of the retainer flaps, the gusset panels pivot with respect to the retainer flaps about the fold lines 74 and 78. The gusset panels 76 ultimately fold to a position where they lie flat against the associated bottom panel flap. The gusset panels 76 thus are positioned below the adjacent bottle so that the bottle rests on them as well as on the bottom panel. In this position the retainer flaps of each cutout are on opposite sides of the heel portion of an adjacent bottle. The weight of the bottle on the gusset panels 76 adds to the forces locking the retainer flaps in their biased position. This final position of the retainer flaps and gusset panels is shown in FIG. 4 without the associated bottle in order to better illustrate this structure. It can be seen that the gusset panel fold lines 82 lie in a plane which makes an acute angle with the horizontal plane of the bottom panel and the gusset panel fold lines 88 lie in a plane which makes an acute angle with the vertical plane of the side panels. In addition to the continual biasing force exerted by the retainer flaps against the sides of the adjacent bottle heel to hold the bottle in place within the wrap-around carrier, the cutout edges formed by the arcuate slits 70 contact the bottle heels to provide the bite or grip normally provided by conventional heel cutouts. Also, the tabs 26 extending down from the side panels 20 exert an inwardly biasing force against the bottles to assist in holding the bottle heels in place.

The carrier should be formed of a material which is sufficiently flexible to permit folding into final form and to provide the biasing properties required of the flap fold lines. Paperboard of the type typically employed in the carrier industry is the preferred choice, since it is economical, readily foldable, and its fibrous nature causes the retainer flap fold lines to be sufficiently biased toward the interior of the package.

It will be understood that the thickness of the carrier elements has been exaggerated for the purpose of illustration. Even though it may seem that the presence of the lower gusset panels 76 between the bottles and the bottom panel flaps would interfere with the ability of the bottles to rest securely against the bottom panel, in practice the thin flexible nature of the paperboard allows the bottles to rest substantially flat against the bottom panel flaps with virtually no interference from the lower gusset panels.

It should now be apparent that the invention provides improved article retainer means in a wrap-around carrier in an economical, efficient manner. The retainer flaps are provided from a conventional size blank and are not difficult to actuate, since their inward movement is initiated by the folding of the gusset panels and their final positioning is brought about by the movement of the bottom panel flaps into final position.

Although described primarily in connection with the packaging of beverage bottles, it will be appreciated that other articles, such as cans, can also be packaged in carriers incorporating the features of the invention. Further, it is contemplated that the invention need not necessarily be limited to all the specific details described in connection with the preferred embodiments, but that changes to certain features of the preferred embodiment which do not alter the overall basic function and concept of the invention may be made without departing from the spirit and scope of the invention defined in the appended claims.

What is claimed is:

1. A package comprised of a wrap-around carrier containing articles having a bottom and lower portions adjacent the article bottom, the carrier comprising:

opposite side panels foldably connected to top and bottom panels;

the carrier including apertures located opposite the lower portions of adjacent articles, the apertures having side edges;

a retainer flap adjacent each side edge of the apertures, the retainer flaps being unconnected to the associated aperture side edge and spaced therefrom, the retainer flaps extending inwardly of the carrier transversely of the side panels and contacting opposite sides of the lower portions of the adjacent articles; and each retainer flap having an upper portion and a lower portion, the upper portion being connected by a fold line to an upper gusset panel and the lower portion being connected by a fold line to a lower gusset panel, the upper gusset panel of each retainer flap being foldably connected to an associated side panel and the lower gusset panel of each retainer flap being foldably connected to the bottom panel.

2. A package as defined in claim 1, wherein at least a substantial portion of each lower gusset panel lies between the bottom panel and the bottom of an associated article.

3. A package as defined in claim 1, wherein each side panel is in a substantially vertical plane and each upper gusset panel fold line lies in a plane forming an acute angle with a horizontal plane and wherein the bottom panel is in a substantially horizontal plane and each lower gusset panel fold line lies in a plane forming an acute angle with the associated side panel.

4. A package as defined in claim 1, wherein the carrier includes sloped heel panels extending between the side panels and the bottom panel, the side edges of the apertures being in the sloped panels.

5. A package as defined in claim 4, wherein the lower side portions of the articles are curved and the side edges of the apertures extend along a substantially arcuate path.

6. A substantially rectangular blank for forming a wrap-around carrier for use in packaging articles having a bottom and lower portions adjacent the article bottom, comprising:

a top panel section;

side panel sections connected to the top panel section along fold lines;

a bottom panel flap at each end of the blank for forming the bottom panel of a carrier formed from the blank;

the blank including spaced cutouts, each cutout being located opposite the intended location of the lower side portions of an article in a carrier formed from the blank;

the blank also including slits outwardly spaced from each cutout, the slits defining the outer side edges of apertures, the portions of the blank between the cutouts and the slits comprising article retainer flaps;

each retainer flap having an upper portion and a lower portion, the upper portion being connected by a fold line to an upper gusset panel and the lower portion being connected by a fold line to a lower gusset panel, the upper gusset panel of each retainer flap being foldably connected to an associated side panel section and the lower gusset panel of each retainer flap being foldably connected to a bottom panel flap.

7. A carrier blank as defined in claim 6, wherein the blank includes heel panel sections extending between the side panel sections and the associated bottom panel sections and wherein the side edges of the apertures are in the sloped heel panel sections.

* * * * *